United States Patent [19]

Hildebrandt

[11] 3,932,158

[45] Jan. 13, 1976

[54] SYSTEM FOR COOLING AN OBJECT WITH COOLANT CYCLE

[75] Inventor: Ullrich Hildebrandt, Munich, Germany

[73] Assignee: Linde Aktiengesellschaft, Wiesbaden, Germany

[22] Filed: Aug. 6, 1974

[21] Appl. No.: 495,238

[30] Foreign Application Priority Data

Aug. 10, 1973 Germany ..... 2340702

[52] U.S. Cl. ..... 62/500; 62/513

[51] Int. Cl.[2] ..... F25B 1/06

[58] Field of Search ..... 62/62, 500, 513, 514, 512

[56] References Cited

UNITED STATES PATENTS

| | | | |
|---|---|---|---|
| 3,434,298 | 3/1969 | Rietdijk | 62/500 X |
| 3,442,093 | 5/1969 | Rietdijk | 62/500 |
| 3,447,339 | 6/1969 | Rietdijk | 62/500 |
| 3,456,456 | 7/1969 | Rietdijk | 62/500 |
| 3,496,735 | 2/1970 | Haisma | 62/500 |

*Primary Examiner*—William F. O'Dea
*Assistant Examiner*—Ronald C. Capossela
*Attorney, Agent, or Firm*—Karl F. Ross; Herbert Dubno

[57] ABSTRACT

An object, such as a superconductive magnet, is cooled by a coolant operating with a single or multi-stage coolant cycle in which the coolant, in the last stage, is partially expanded, cooled in a separator-evaporator and fed to the object to be cooled. At least a portion of the coolant fluid, following passage through the object, is expanded through a throttle to form a liquid-gas phase mixture which is separated in the separator-evaporator, the gas phase being recirculated. The expansion of the coolant fluid prior to entry into contact with the object is carried out according to the invention in one or more ejectors whose suction side or sides draws a portion of the cooling fluid from part of the cycle elsewhere into the stream fed to the object to increase the mass flow.

8 Claims, 15 Drawing Figures

SYSTEM FOR COOLING AN OBJECT WITH COOLANT CYCLE

FIELD OF THE INVENTION

The invention relates to a system for the cooling of an object, e.g., a superconductive magnet or other superconductor system and, more particularly, to a single or multistage system in which a coolant is expanded prior to entry into heat-exchanging relation with the object.

BACKGROUND OF THE INVENTION

In the cooling of cryogenic devices, e.g. superconductive magnets, cable systems and the like, a recirculated coolant is brought to a low temperature in one or more stages and, in the last state, is partially expanded and fed to the object, preferably after passing in indirect heat exchange with the coolant fluid in a separator-evaporator. The separator-evaporator contains a body or bath of liquified coolant, e.g., helium, which may be partially evaporated in the indirect heat exchange with the coolant fed to the object. The cooling fluid, after traversing the object, may be further expanded to produce a liquid-gas phase mixture which is passed into the separator-evaporator so that the gas phase can be recirculated while the liquid phase is accumulated.

In general, the expansion of the fluid prior to its passage through the separator-evaporator in indirect heat exchange and into the object to be cooled takes place through a conventional throttle valve.

Such systems are known for helium circulation cycles in the cooling of superconductive magnets and may include one or more precooling stages in which the cooling fluid, previously compressed, is cooled by heat exchange and by subsequent expansion. Generally there is at least one expansion stage ahead of the final heat exchanger which, as described, may be a separator-evaporator containing a bath of the liquefied coolant so that the expanded stream is supercooled in indirect heat exchange with the liquid bath and then supplied to the object. The gas phase leaving the separator-evaporator may be used for heat exchange cooling of the compressed cooling fluid in one or more heat exchangers separated by expansion stages and is ultimately compressed to be recirculated to the stream flowing to the object.

The cooling effectiveness at the object to be cooled is proportional to the enthalpy difference across the inlet and outlet of the object multiplied by the mass flow of the coolant through the object. For superconductive magnets, to coolant through the object. For superconductive magnets, to maintain the superconductive state against the increase in enthalpy of the coolant, the temperature difference across the cooling object must be maintained as small as possible so that, for a given temperature and type of coolant, the desired result can only be maintained by increasing the mass flow of the coolant through the object.

However, in conventional systems this mass flow is established by the maximum throughput at the warm end of the last stage of the cooling cycle. It should be apparent that dimensioning the last stage of the coolant cycle to accommodate an initially large mass flow of coolant requires, in conventional arrangements, a corresponding increase in the dimensions of the capacities of the previous stages. This results in unnecessary both for operating energy and construction.

OBJECTS OF THE INVENTION

It is the principal object of the present invention to provide an improved method of cooling an object so that, for a given object and cooling effectiveness, the system can operate at lower cost and be less expensive.

It is another object of the invention to provide a method of cooling an object to cryogenic temperatures whereby disadvantages of earlier systems may be obviated.

It is still another object of the invention to provide an improved cooling system for superconductive magnets and the like.

SUMMARY OF THE INVENTION

These objects and others which will become apparent hereinafter are attained, in accordance with the present invention, by providing along the path of the coolant to be fed to the object, one or more expansion stages in the form of ejectors whose suction sides can draw cooling fluid emerging from the object to be cooled.

By the substitution of ejectors for throttle valves for the expansion of the coolant, I obtain the significant advantage that additional energy from a foreign source is not required nor are moving parts necessary to increase the mass flow of the coolants through the object to maintain a constant cooling effectiveness and maintain the enthalpy loss within the object as small as possible. The overall result is a more uniform efficient cooling of the object.

The cost of cooling the object is reduced and the system has been found to be especially suitable for the low cost of superconductive systems, especially magnets and low temperature cables, where only minimum temperature increases can be tolerated.

Depending upon the temperature of the coolant which is desired at the outlet of the ejector, the suction side may be connected to a source of gaseous or liquid coolant.

When expansion is carried out in two stages in cascade, it is preferred to expand the coolant in the first expansion stage in a first ejector to an intermediate pressure and more fully expand the coolant in the second stage to approximately the pressure at which the coolant is to enter the object. Either or both of the expansion steps can make use of an ejector and, where only one ejector is used, a conventional expansion valve may be employed for the other expansion step.

When the first expansion step is carried out with an ejector, the suction side thereof may be connected to a branch from the outlet line of the object directly or after the induced coolant has been passed through a heat exchanger to be warmed.

When the second expansion stage is constituted by the ejector, the suction side of the latter can draw either liquid from the bath of the separator-evaporator or fluid from the outlet of the object before the fluid enters the separator-evaporator, or fluid from the second separator-evaporator, or gas from the separator-evaporator, or gas from a heat exchanger fed by fluid drawn from the separator-evaporator.

Where both expansion steps utilize ejectors, the systems descibed immediately above can be combined, i.e. the ejectors may draw the fluid from the same source or from difference sources.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
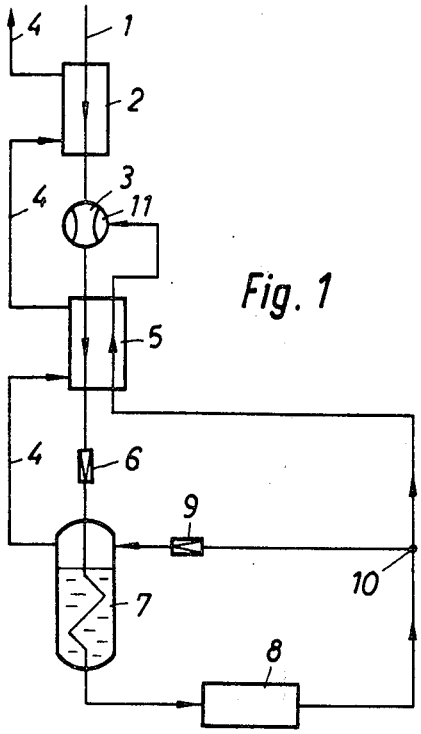
FIGS. 1 – 15 are flow diagrams illustrating various embodiments of the present invention.

In the description below of the several embodiments of the invention, similarly functioning and similarly construction parts are designated by similar reference numerals.

In the drawing only part of the cooling system is shown in detail, i.e., the portions corresponding to the last cooling stage. The coolant or refrigerant is helium and in each embodiment the last stage makes use of two-stage expansion of the coolant.

FIG. 1 shows a feed conduit 1 for delivering gaseous helium through an indirect heat exchanger 2 and into a venturi-type ejector 3 of conventional design, the ejector constituting an expansion device replacing the usual expansion throttle. The structure of the ejector 3 may be similar to that of the ejector shown at page 9 - 101 of MARK'S MECHANICAL ENGINEERS' HANDBOOK, McGraw-Hill Book Company, New York, 1958.

The gaseous helium is expanded from its original high pressure to an intermediate pressure in the ejector 3 which constitutes the first expansion stage of the last part of the cooling system. After this initial expansion, the coolant is passed through a further heat-exchanger 5 and is additionally cooled therein before being expanded through a conventional throttle valve 6 in the second expansion stage.

Partly liquified helium or helium at a supercritical pressure passes into a separator-evaporator 7, in which it is subjected to indirect heat exchange with the liquid phase or both accumulated in this unit. The helium is thus supercooled and is directed into the body or object 8 to be cooled, e.g. a superconductive magnet or a chamber enclosing same. The helium abstracts heat from the object 8 and is thereby slightly warmed.

The helium stream emerging from the object 8 is split into two streams by a flow splitter or distributing valve 10. One stream is expanded through a throttle valve 9 into the separator-evaporator 7 wherein the liquid phase of the expanding mixture accumulates to form the liquid-helium bath where the gas phase collects on top of the liquid phase. The throttle valve 9 thus partly liquifies liquefies helium after it has abstracted heat from the object 8.

The vapor phase is drawn from the separator-evaporator 7 and passed by conduit 4 through the heat-exchangers 5 and 2 in succession, preferably before being fed to earlier stages of cooling cycles not shown. These earlier stages can comprise compressors, expansion nozzles and heat-exchangers for disipating the thermal energy picked up by the gaseous helium in this last stage.

The other partial stream from object 8 is partly warmed in the heat-exchanger 5 in indirect heat exchange with the gaseous helium passing through the conduit 4, ejector being drawn into the suction side 11 of the efector 3. In the ejector 3, this gaseous partial stream of helium is entrained with the helium cooled in heat-exchanger 2 through the separator-evaporator 7 and then again into the body 8 to be cooled.

The system of FIG. 1 is relatively simple and eliminates the need for external energy to be supplied to the system for increasing the mass flow of helium through body 8 by comparison with the mass flow of helium at the duct 1. The advantage in this system is that the ejector 3 induces (draws) helium of higher enthalpy than is supplied to the pressure inlet of the ejector, into the latter, thereby increasing the enthalpy of the fluid emerging from the ejector by comparison with the fluid fed from heat exchanger 2, and increasing the temperature difference across the heat exchanger 5.

Figure 2:
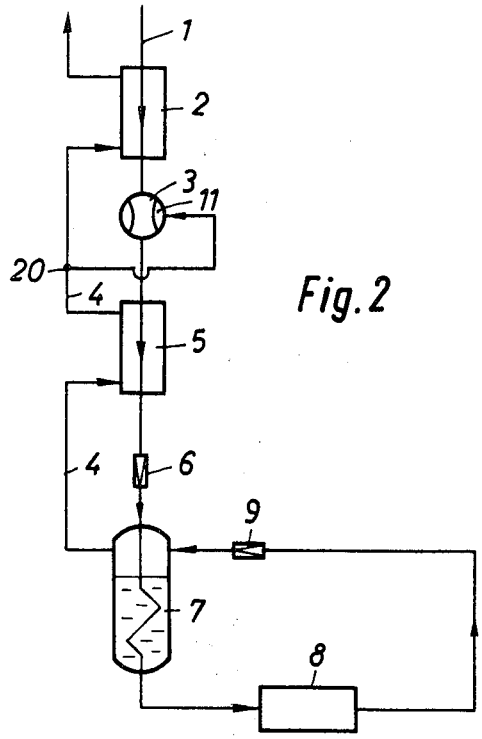

In FIG. 2 I show a modification of the base system of FIG. 1 wherein the suction side of the upstream ejector 3 is tied at 20 to a flow splitter connected to conduit 4 between the heat exchanger 5 and the heat exchanger 2. In this case the helium stream from the object 8 need not be diverted and all can pass through the throttle 9 and into the separator-evaporator 7. Only the gas phase from this separator continues along conduit 4 and is branched after it traverses the heat exchanger 5 to flow partly to the heat exchanger 2 and partly to the suction side of the ejector 3.

This embodiment has the advantage that the helium introduced on the suction side of the ejector need not pass through a separate section of the heat exchanger 5 to be warmed.

Figure 3:
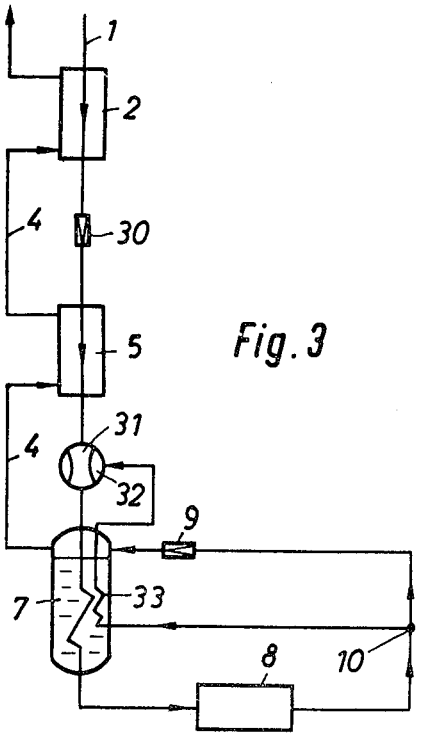

A further modification of FIG. 1 is shown in FIG. 3 wherein the upstream expansion is effected with a conventional throttle valve 30 disposed along the line 1 between the heat exchanger 2 and the heat exchanger 5. In this case the throttle valve 6 of the embodiment on FIG. 1 is replaced by a ejector 31 whose suction side 32 is connected through a heat exchange section (tube, coil or the like) of the separator-evaporator 7 and is in contact with the liquid bath thereof.

The gases discharged from object 8 to be cooled are split into two partial streams, namely, a first stream which passes through the throttle valve 9 as previously described into the separator-evaporator 7 so that the liquid phase of the partial condensate collects in the liquid bath of this separator 7. The gas phase is passed above the liquid bath into the duct 4.

The remaining partial stream flows through the heat exchange section 33 and is cooled in indirect heat exchange with the liquid bath in the separator-evaporator 7 to a two-phase mixture, to a gas at supercritical pressure, or to a liquid prior to entry into the suction side of the ejector.

This embodiment permits the charging, at the ejector 31 of liquified or supercritical helium at high pressure (i.e., the pressure at the discharge side at the object 8) into the helium stream before it traverses the heat exchange portion of separator-evaporator 7 to increase the helium mass flow through the object 8 without any moving parts.

In the modification of FIG. 4 the ejector 31 is again placed between the heat exchanger 5 and the separator-evaporator 7, at the suction side 32 of the ejector is connected at 40 to the line 4 passing between the gas space of unit 7 and the cold end of the heat exchanger 5. This embodiment, as in the embodiment of FIG. 2, eliminates the need for the second heat exchange section 33 of the system of FIG. 3.

The helium gas drawn from the gas space of the separator-evaporator 7 is split into two partial streams, the first proceeding directly to the heat exchanger 5, while the other is introduced at 32 into the suction side of the ejector to increase the mass flow of helium traversing the object to be cooled. A distributing valve 40 may be provided to split the gas stream into two partial streams.

As has previously been noted in connection with FIG. 3 it is particularly desirable to introduce a fluid into the stream to increase the mass flow of helium through the object to be cooled in the form of a liquid. Where in the system of FIG. 3 this liquid could be obtained by condensation in the heat exchange section 33, in the embodiment of FIG. 5, the liquid is drawn directly from the liquid bath of the separator-evaporator 7. This embodiment likewise has the advantage over FIG. 3 that a separate heat exchange section in the separator-evaporator 7 is unnecessary.

Of course, the portion of the helium stream diverted from the outlet of the object 8 need not be passed through the cooler 33 in order to feed the ejector 31. A simplified construction utilizing this principal has been shown in FIG. 6. In this system, the suction side 32 of the ejector 31 is connected directly with the outlet of the object 8 through the flow splitter 10 previously described. While this system eliminates the heat exchanger with liquid a separator-evaporator 7, there is the advantage that a smaller suction froce is required at the ejector 31 since the fluid induced into the ejector is primarily in a gaseous state.

As suggested above it is possible to combine one or more of the basic principles illustrated in FIGS. 1 – 6 and to further increase the mass flow of the cooling gas. There is in FIG. 7, a first ejector 3 is provided as the first expansion stage between the heat-exchanger 2 and the heat-exchanger 5 which has a separate heat exchange section as described in connection with FIG. 1. The ejector 31 is also disposed between the heat exchanger 5 and the separator-evaporator 7 which has a cooling section 71 as described in connection with FIG. 3. Combining features of FIGS. 1 and 3, the arrangement of FIG. 7 taps a partial stream from the coolant emerging from the object 8 through the heat exchange section 71 and into the suction side 32 of the ejector 31. To this extent the system operates identically to that of FIG. 3.

One portion of fluid emerging from the object 8 is split at 10 to pass through the throttle valve 9 and into the separator-evaporator 7 so that condensate liquid may collect therein. The other portion of the stream effluent from the object 8 traverses the separate section of heat exchanger 5 and is drawn into the suction side 11 of the separator-evaporator 7. The mass flow of helium is thus augmented at each expansion stage. In the first ejector of each of the systems of FIGS. 7 – 14, the helium is expanded to an intermediate pressure and in the second ejector 31 to the input pressure at the object 8.

Figure 4:
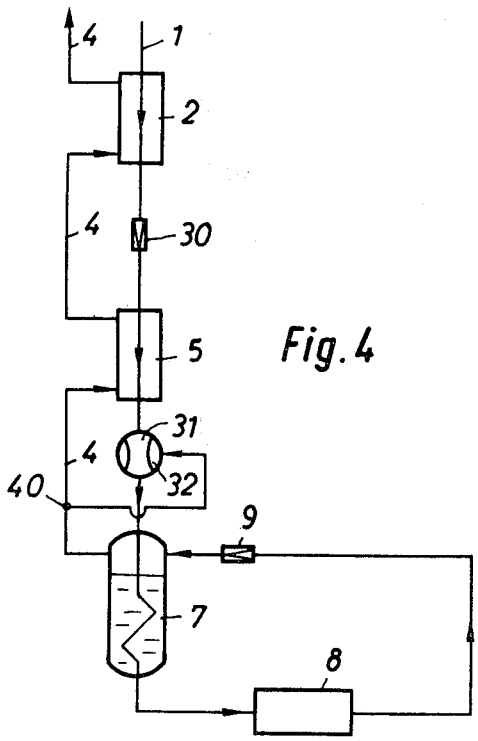
Figure 8:
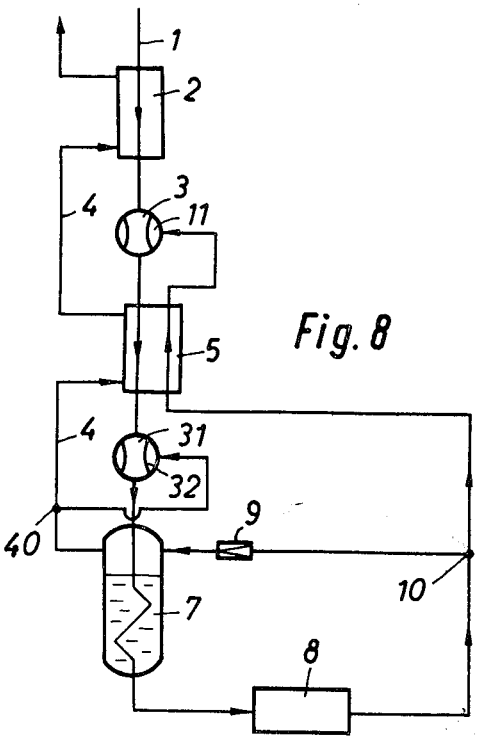

In the embodiment of FIG. 8 a system having characteristics to those of FIGS. 1 and 4 has been illustrated. In this arrangement, the ejector 3 draws at its suction side 11, a partial stream of the fluid emergent from the object 8 (through the separate section of heat exchanger 5) after the effluent fluid is split at 10. The ejector 31, however, draws its gaseous stream from a junction 40 with line 4 connected to the gas space of the separator-evaporator 7. Of course the system operates as described in connection with FIGS. 1 and 4.

Figure 5:
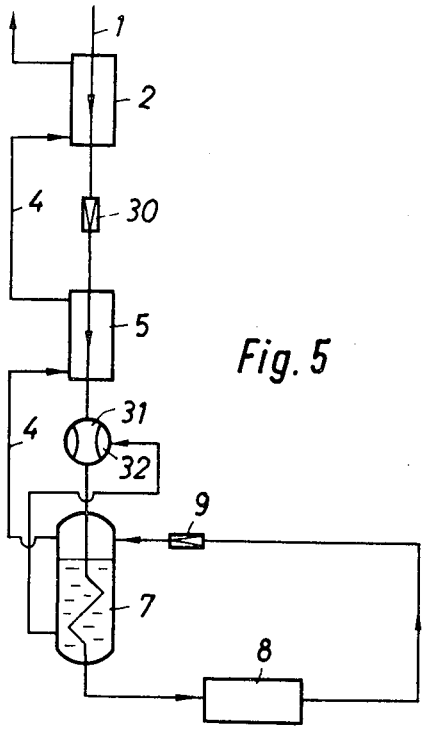
Figure 9:
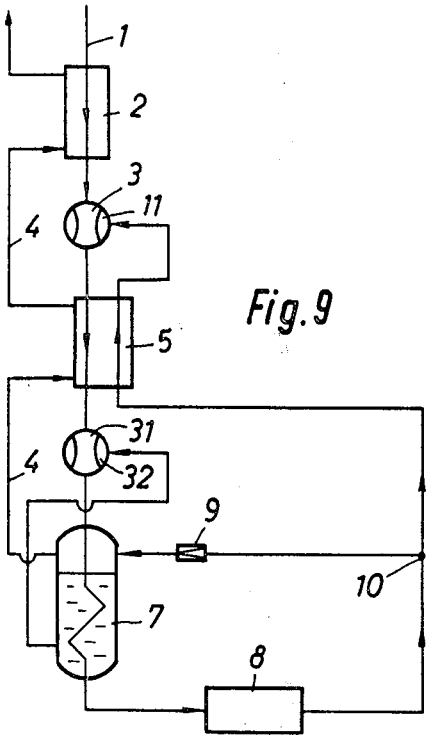

FIG. 9 illustrates an embodiment which operates as described in connection with FIGS. 1 and 5 since here the second ejector 31 draws liquid into its suction side 32 from the liquid helium bath of the separator-evaporator 7.

Figure 10:
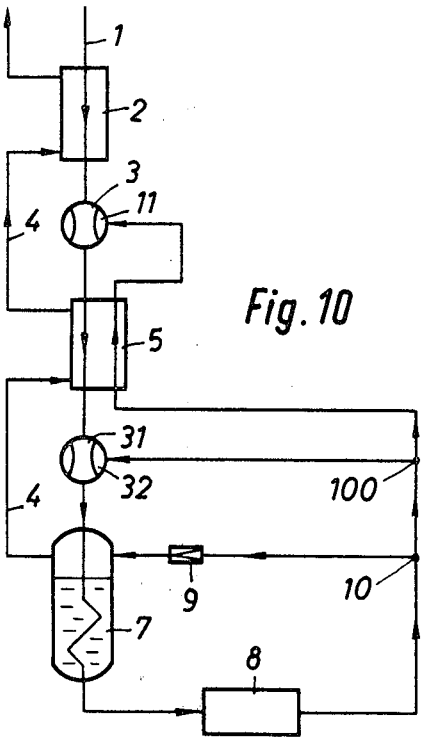

FIG. 10 shows a modification of the system of FIG. 7 which combines features of FIGS. 1 and 6 and operates as described in connection therewith. In other words, where the suction side 11 of ejector 3 is connected to a junction 100 with the fluid discharged from the object 8, via a separate section of the heat-exchanger 5, the other partial stream of the effluent fluid is passed directly into the suction side 32 of the ejector 301. Here, of course, ejector 31 draws gas, rather than liquid, into the recirculating mass flow. However, this system has been found to be advantageous when the object 8 is cooled at supercritical pressure so that during the cooling there is no phase transformation of the helium.

Figure 11:
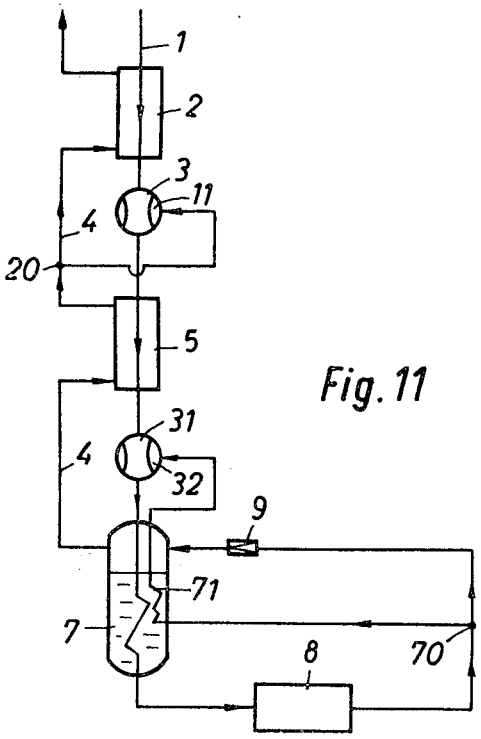

A further variant has been shown in FIG. 11 which combines characteristics of the system of FIG. 2 and that of FIG. 3 and operates similarly. The second ejector 31 draws a portion of the gas stream from the outlet side of the object 8 into its intake side after its intake side after this portion of the fluid has been cooled in the tube coil 71 of the bath of separator-evaporator 7.

Figure 12:
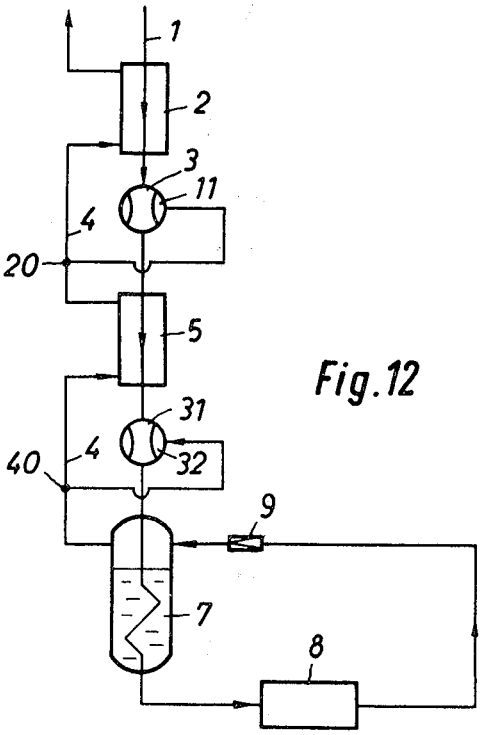

FIG. 12 represents a modification combining features of FIGS. 2 and 4 and operating as described in connection with these figures. In the system of FIG. 12 the suction side 32 of the second ejector 31 draws a portion of the gas phase from the top of the separator-evaporator 7 into the coolant helium stream while the first ejector 31 withdraws from line 4 at flow splitter 20, another portion of the same gas stream, although after it has been traversed the heat exchanger 5 and prior to its entry into heat exchanger 2.

Figure 13:
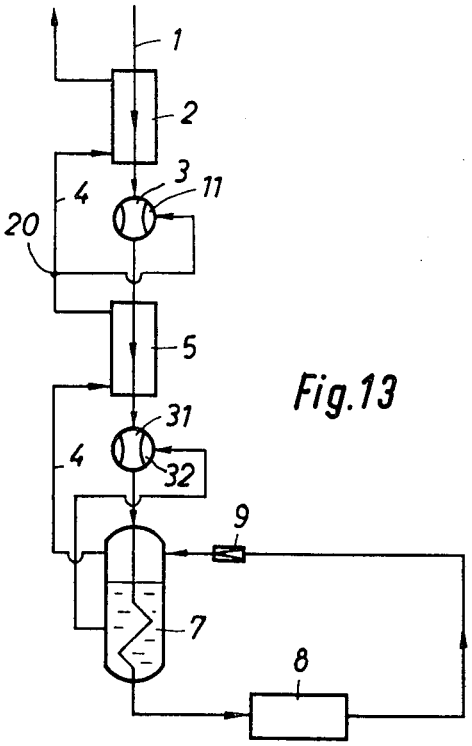

The modification of FIG. 13 represents a system of the features of FIGS. 2 and 5 and is operable as described in connection with these figures. In this case the system differs from that of FIG. 12 only in that, a portion of the liquid helium in the bath of separator-evaporator 7 is drawn into the suction side of ejector 31.

Figure 6:
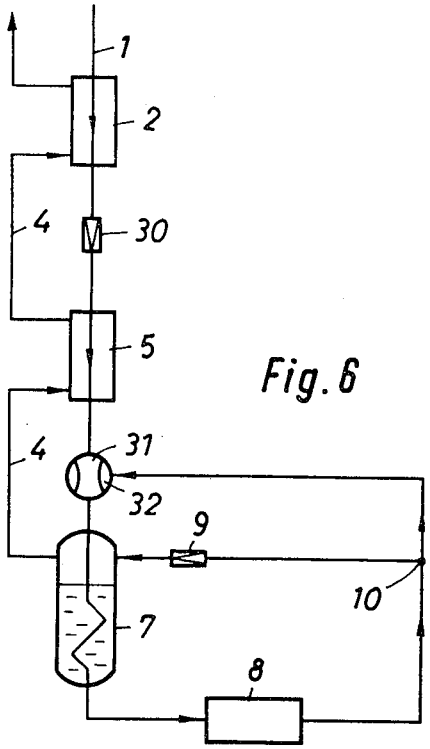
Figure 7:
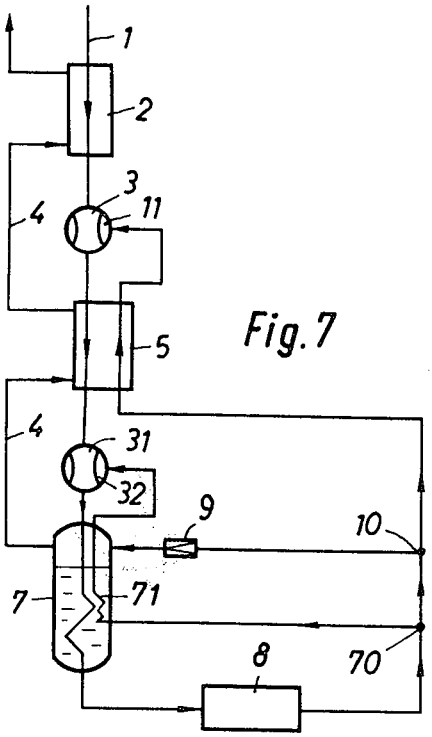
Figure 14:
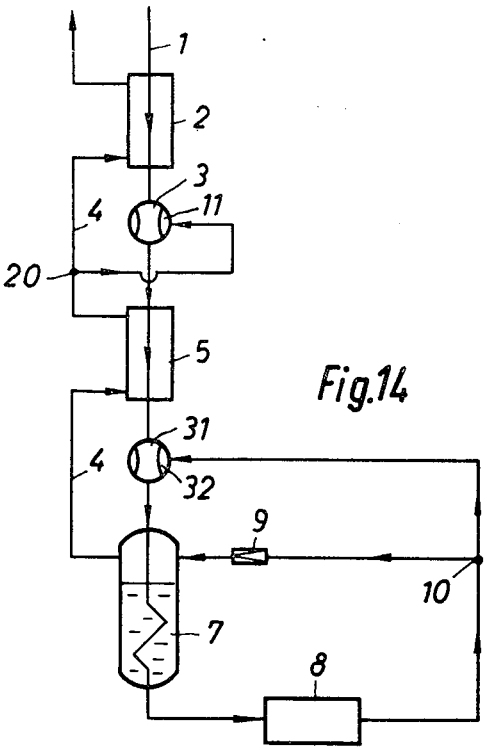

FIG. 14 represents an embodiment combining features of FIGS. 2 and 6, the system deviating from FIG. 13 in that the suction side of the ejector 31 is connected to a flow splitter 10 served by the outlet side of object 8.

Figure 15:
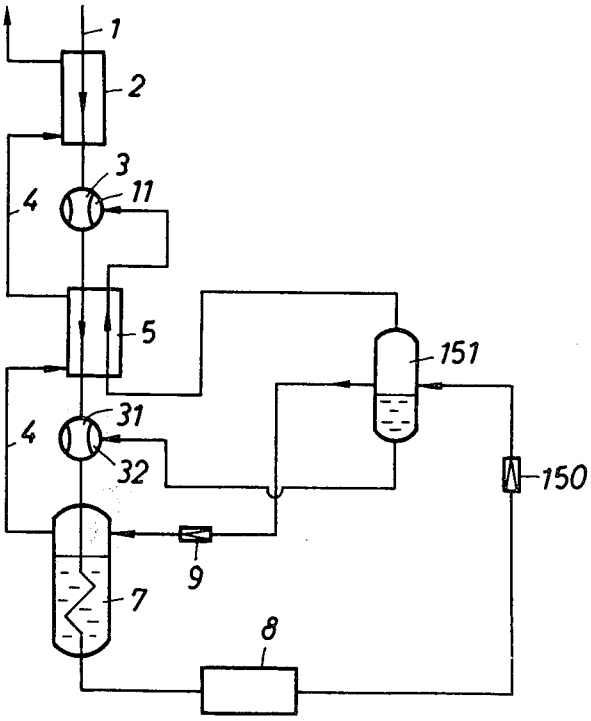

A somewhat more complex arrangement has been shown in FIG. 15 and this system has been found to be especially suitable when the helium effluent from the object 8 constitutes a two-phase mixture. In this case the two-phase mixture is fed, e.g., by an expansion valve 150, to a further gas liquid separator 151 in which a phase separation of the helium takes place at a slightly higher pressure than that of separator-evaporator 7. The liquid phase is delivered totally or partially to the suction side of ejector 31 where a part of the helium vapor (gas phase) is supplied to the suction side of ejector 3 and another part to the throttle valve 9 communicating with the separator-evaporator 7.

The modification of FIG. 15 operates in principal as described in the embodiment of FIG. 10.

The additional separator 151 can also be used in the embodiments of FIGS. 1, 6 – 9 and 14. When the separator 151 is provided in these systems, the fluid outlet is omitted in the arrangements of FIGS. 1, 8 – 9 and the gas outlet is omitted in the arrangements of FIGS. 6 – 14. When it is used in the variant of FIG. 7, the liquid outlet is omitted and the separator 151 is provided at the branch 10 where the throttle valve 150 is provided between branch 170 and the separator 151.

I claim:

1. The system for cooling of an object comprising a first heat exchanger traversed by a stream of compressed coolant;

a first expansion stage downstream of said first heat exchanger for expanding said coolant to an intermediate pressure;

a second heat exchanger downstream of said first stage and traversed by the fluid at intermediate pressure;

a second expansion stage downstream of said second heat exchanger for expanding the fluid traversing same to a pressure substantially equal to the fluid pressure to be maintained at the inlet to said object;

a separator-evaporator having a bath of liquefied fluid and a gas space for vapor thereof above said bath;

means for passing fluid from said second expansion stage in indirect heat exchange with the said bath and into said object;

means for feeding fluid effluent from said object through a throttle into said separator-evaporator;

means for passing gas from said space through said heat exchangers in cascade, at least one of said expansion stages being constituted by an ejector having a suction side; and means for feeding a portion of fluid emerging from said object to said suction side.

2. The apparatus defined in claim 1 wherein the fluid effluent from said object is branched into at least two partial streams, at least one of said streams being fed to said suction side by the last mentioned means.

3. The apparatus defined in claim 1 wherein liquid from said separator-evaporator is fed to said suction side by the last mentioned means.

4. The apparatus defined in claim 1 wherein the last mentioned means includes a section of said second heat exchanger.

5. The apparatus defined in claim 1 wherein the last-mentioned means includes a section in said separator-evaporator in heat exchanging relation with the liquid therein.

6. The apparatus defined in claim 1, further comprising a liquid-gas phase mixture separator connected to said object for separating said effluent into gas and liquid portions.

7. The apparatus defined in claim 6 wherein the last mentioned means includes a duct communicating with said separator to draw liquid therefrom into said suction side.

8. The apparatus defined in claim 6 wherein the last-mentioned means includes a duct connected with said separator to draw gas therefrom.

* * * * *